United States Patent [19]

Ogata et al.

[11] 4,139,288

[45] Feb. 13, 1979

[54] MICROFILM TYPEWRITER

[75] Inventors: Takashi Ogata; Tatsumi Arakawa; Kiichiro Sasaguri; Hidehiko Kobayashi, all of Fuji, Japan

[73] Assignee: Asahi Kasei Kogyo Kabushiki Kaisha, Osaka, Japan

[21] Appl. No.: 782,819

[22] Filed: Mar. 30, 1977

[30] Foreign Application Priority Data

Mar. 31, 1976 [JP] Japan ..... 51-35649

[51] Int. Cl.[2] ..... B41B 15/06; B41B 15/16

[52] U.S. Cl. ..... 354/7; 354/5; 354/16

[58] Field of Search ..... 354/4, 5, 7, 16, 14, 354/15

[56] References Cited

U.S. PATENT DOCUMENTS

| | | | |
|---|---|---|---|
| 2,742,831 | 4/1956 | Wirtz | 354/15 |
| 3,320,851 | 5/1967 | Fischer | 354/11 X |
| 3,590,705 | 12/1967 | Moyroud | 354/15 X |
| 4,044,363 | 8/1977 | Morgan | 354/7 X |

FOREIGN PATENT DOCUMENTS 1402760 8/1975 United Kingdom.

*Primary Examiner*—Michael L. Gellner

*Attorney, Agent, or Firm*—Sughrue, Rothwell, Mion, Zinn and Macpeak

[57] ABSTRACT

A pattern of a character, numeral or symbol on an optical mask is selected in accordance with the designation by a character designator and irradiated with light from a printing light source. The light is converted into a light of the pattern of the designated character, numeral or symbol by a optical mask, the pattern being of a size ranging from about 20 to about 500 μm, and the converted light reaches a thin layer of a dispersion imaging material formed on a recording medium to cause at least dispersion of the thin layer, thereby to print the pattern of the designated character, numeral or symbol. A recording medium support and the position of irradiation of the recording medium with the converted light are moved by a drive relative to each other, so that characters, numerals and symbols can be printed on the recording medium one by one. The characters, numerals and symbols printed on the recording medium in the region including the recording medium irradiating position are optically displayed by a projector during the printing operation.

10 Claims, 14 Drawing Figures

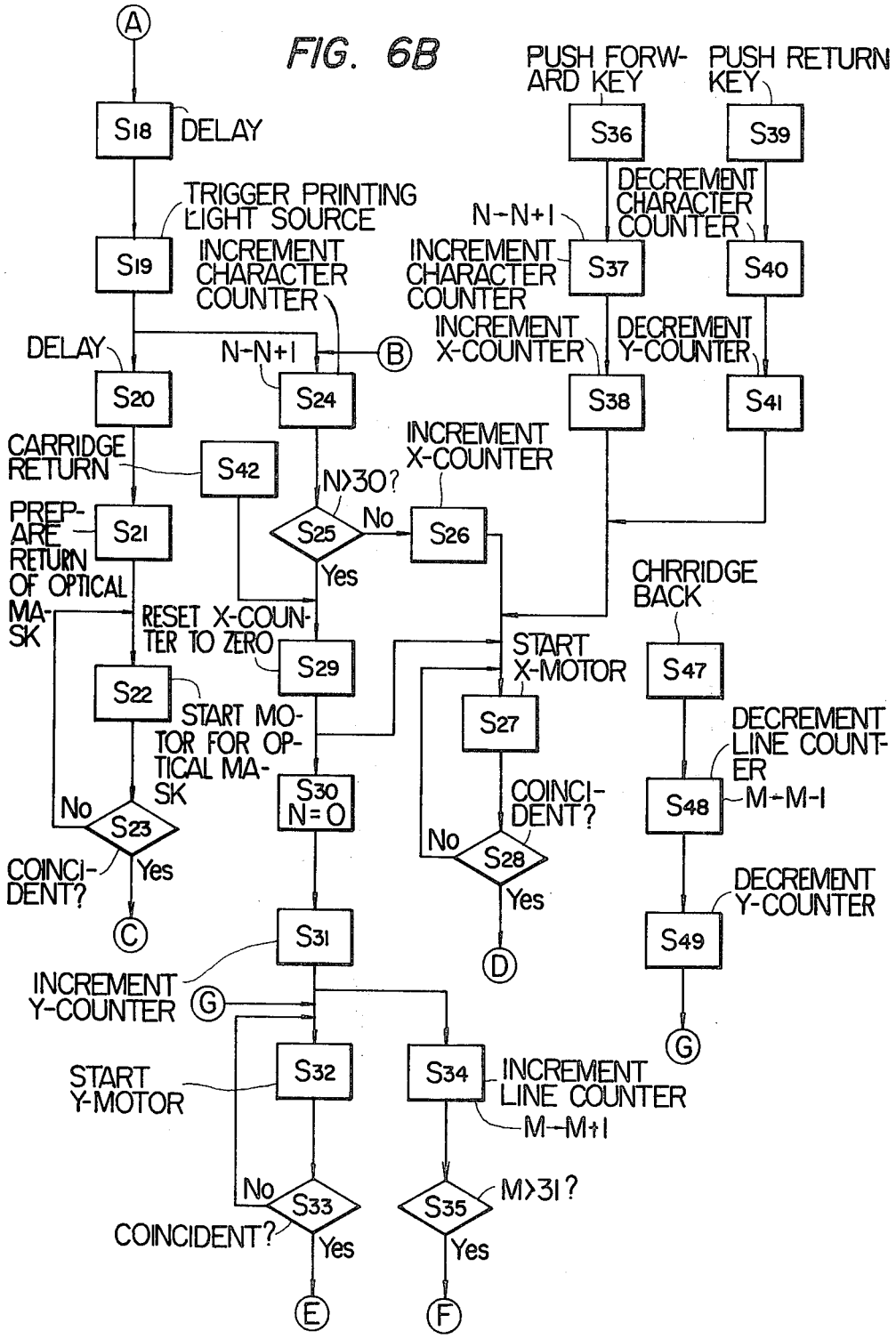
FIG. 6B
A
S18
DELAY
S19
TRIGGER PRINTING LIGHT SOURCE
DELAY
S20
CARRIDGE RETURN
S42
PREP-ARE RETURN OF OPTICAL MA-SK
S21
RESET X-COUN-TER TO ZERO
S22
START MO-TOR FOR OP-TICAL MA-SK
No
S23
COINCI-DENT?
Yes
C
INCREMENT CHARACTER COUNTER
N←N+1
B
S24
N>30?
S25
No
Yes
S26
INCREMENT X-COUNTER
S29
S30
N=0
S31
INCREMENT Y-COUNTER
G
S32
START Y-MOTOR
No
S33
COINCIDENT?
Yes
E
S34
INCREMENT LINE COUNTER
M←M+1
S35
M>31?
Yes
F
PUSH FORW-ARD KEY
S36
N←N+1
INCREMENT CHARACTER COUNTER
S37
INCREMENT X-COUNTER
S38
START X-MOTOR
S27
COINCI-DENT?
No
S28
Yes
D
PUSH RETURN KEY
S39
DECREMENT CHARACTER COUNTER
S40
DECREMENT Y-COUNTER
S41
CHRRIDGE BACK
S47
DECREMENT LINE COUNT-ER
S48
M←M-1
DECREMENT Y-COUNTER
S49
G

MICROFILM TYPEWRITER

BACKGROUND OF THE INVENTION

This invention relates to a microfilm typewriter e.g. a printer for optically printing small characters, numerals and symbols one by one.

Typewriters now in use are to print characters, numerals and symbols large enough to be read directly by naked eyes, and most of them are adapted to accomplish mechanical printing using types. Recently, a very large amount of information has come to be handled and, for the purposes of storing and using such information, microfilm systems have come into wide use. However, ordinary microfilm systems now in use are to make reduced copies of printed, copied, handwritten or typewritten documents by the employment of a photographic camera.

It would be very convenient if a micro character could be added to microfilm data when required. Recently, in offices, hospitals and so on, it is highly desired to realize such apparatus or apparatus capable of printing micro characters directly on a microfilm from the beginning, that is, the so-called microfilm typewriter. Such apparatus is almost impossible to realize with conventional typewriters partly because of a difficulty in the making of extremely small types required therefor and partly because of possible deformation of characters, wear of the type face and so on.

To avoid such a mechanical printing method, it is theoretically possible to employ such an optical printing method that a pattern of a character is optically printed by leading the pattern to a recording paper through a bundle of optical fibers. Also with this method, it is very difficult to transmit a very small micro character through the bundle of optical fibers. Another conventional printing apparatus of the type optically printing characters one by one is such as a photo-typegraphic composing machine for producing a printing plate, but printed characters, numerals and symbols cannot be read immediately after printed.

U.S. Pat. No. 3,207,051 sets forth apparatus in which characters can be optically printed one by one and the printed characters can be read. With this apparatus, however, the characters to be printed are relatively large and ultraviolet-ray sensitive material requiring thermal development is used as a recording paper, so that a development process is indispensable, making it very difficult to read printed characters at the printed position during printing.

An object of this invention is to provide a microfilm typewriter with which it is possible for the operator to rapidly and distinctly record very small characters, numerals and symbols one by one while checking for an error in the printed characters, numerals and symbols and in the arrangement thereof.

Another object of this invention is to provide a microfilm typewriter which enables the operator to immediately read a printed character, numeral or symbol together with those already printed in the vicinity of the printing position, and which is relatively simple in construction and small in size and has a long life.

SUMMARY OF THE INVENTION

In accordance with this invention, a character, numeral and symbol (hereinafter referred to as the character) to be printed is designated by a selective operation of character designating means such, for example, as a keyboard, as is the case with conventional typewriters, Light of a printing light source is converted by optical mask into a light which has a pattern of the designated character and whose spot size is in the range from about 20 to about 500 μm. The optical mask which has formed thereon character patterns, each being of a size ranging from about 20 to about 500 μm. The light of the character pattern, converted by the optical mask, irradiates a recording medium placed adjacent the optical mask. The recording medium is one that a thin layer of a dispersion imaging material is formed on the substrate. By the printing light irradiating the recording medium, the dispersion imaging material is caused to disperse, whereby the character pattern is printed on the recording medium. For printing the next character by the side of the printed position, recording medium support means and the printing light irradiating position are moved by moving means a distance of one character relative to each other.

Further, read-out light is applied to the recording medium at the printing light irradiated position and the neighboring region to thereby provide magnified displays of printed characters on a fixed screen. Accordingly, the operator can perform the printing operation while looking at the screen to check whether the characters having been just printed are correct or not and whether the printed character arrangement is proper or not. Also, the recorded content and the printed character arrangement of the recording medium already printed, that is, a recorded microfilm, can be checked by displaying the record on the fixed screen after the printing operation and, if necessary, additional information can be recorded on the microfilm. The very small character, numeral and symbol, that is, the micro character, mentioned herein, is of such a size that its one side is in the range of about 20 to about 500 μm. The reasons for this dimensional limitation are that characters smaller than about 20 μm require a very large magnifying power for their magnified display on the screen and present various problems, and that characters larger than about 500 μm are too large to keep the meaning of the micro character printing to which this invention is directed.

The optical mask is preferred to be a negative mask that the character pattern portions are transparent, with their background opaque. In this case, the character patterns are aligned in a line and the regions of the opaque portions are limited and surrounded by transparent portion to minimize the influence of the optical mask on the read-out of printed characters. However, in order to ensure good printing, the area of each opaque portion is selected about 2 to about 100 times that of the character pattern. Another way to minimize the influence of the optical mask on the read out of printed character is to select the optical density of the opaque portion to range from about 0.1 to about 1.0. The image of a record on the part of the recording medium which is shaded by the opaque portion, is darker than the image of a record on the other part on the fixed screen, but the abovesaid image can be read out satisfactorily. The printing light passes through the transparent portion, and hence enables sufficient dispersion of the dispersion imaging material of the recording medium. On the other hand, light energy passing through the opaque portion is smaller than the threshold value for the dispersion of the dispersion imaging material.

On the optical mask, for instance, character patterns are arranged on the same circle at equiangular intervals, with the opaque portions of their background formed continuous to adjacent ones of them, and a transparent portion corresponding to a full page when it is projected is also provided on the abovesaid circle. In the case of achieving printing by applying the printing light to the circle at a predetermined position, the optical mask is turned to bring the character pattern of a selected character to the printing light applying position and, after the printing, the abovesaid transparent portion is brought back to the printing light applying position and then a display of the printed character, untouched by the optical mask, is provided by a read-out light on the fixed screen. If an index for the next printing is attached to the transparent portion at the printing light applying position, the index appears on the fixed screen to indicate the next printing position.

A gap of about 5 μm to about 2 mm is provided between the recording medium and the pattern forming surface of the optical mask to prevent the optical mask and the recording medium from inflicting injury on each other and ensure their smooth and correct movement relative to each other. To perform this, a pressurized gas is blown between the recording medium and the optical mask to separate them from each other and means is provided for generating a biasing force which tends to approach the recording medium and the optical mask close to each other, and the separating and approaching forces can be balanced each other. Also, a gas pressure can be employed as the approaching force. By interlocking the read-out light source with the recording medium, a relatively small screen can be used as the fixed screen is held substantially constant to allow ease in reading the display.

BRIEF DESCRIPTION OF THE DRAWINGS

FIGS. 6A and 6B show a flow chart illustrating an example of the operation of the electric circuit shown in FIG. 5;

DESCRIPTION OF THE PREFERRED EMBODIMENTS

Figure 1:
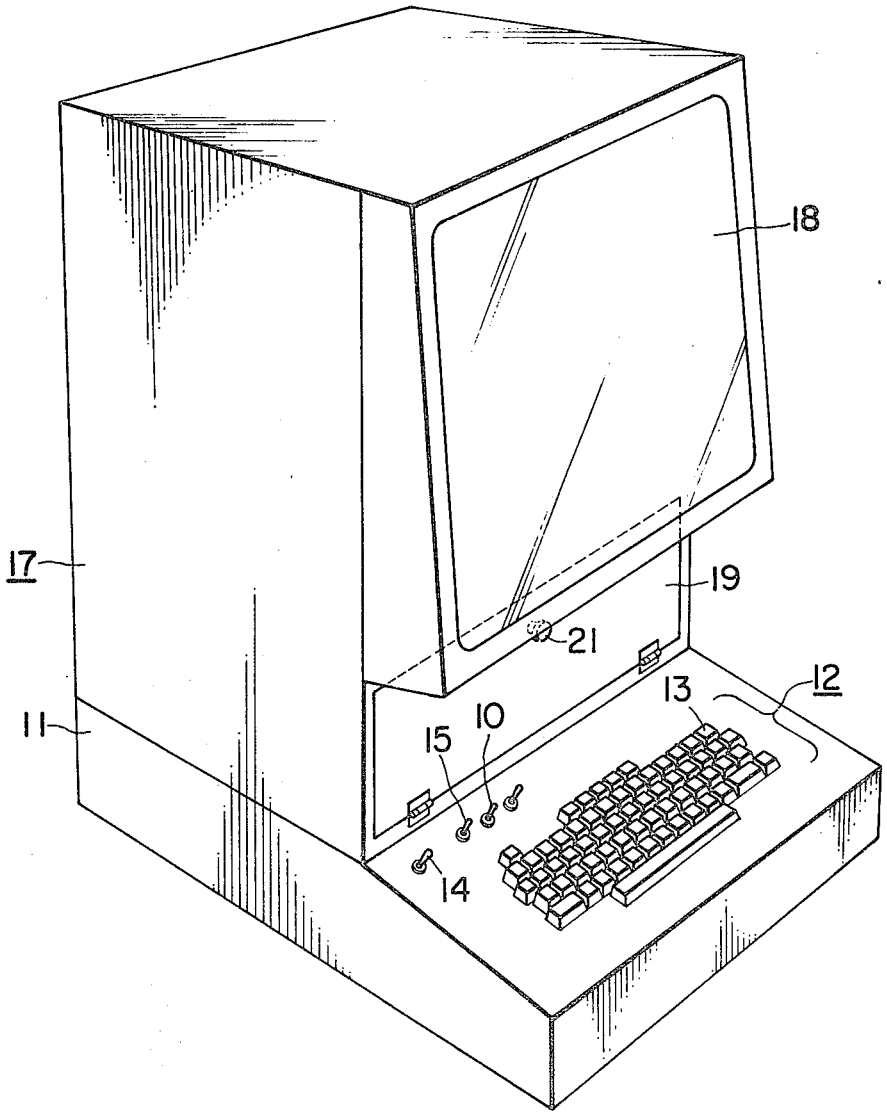
FIG. 1 is a perspective view showing the external appearance of one embodiment of a microfilm typewriter of this invention.

FIG. 1 shows, in perspective, the appearance of a microfilm typewriter according to this invention. Its lower casing 11 has disposed therein a power source, electronic circuits and so on, and the sloping front panel of the casing 11 has arranged thereon a keyboard generally indicated by 12. The keyboard 12 is substantially the same as that of an ordinary typewriter, and includes keys 13 corresponding to respective characters, a space key, a carriage return key, a left shift key, a right shift key, a main power supply switch 14, a character spacing setting lever 15, a character pitch setting lever 16, etc.

Behind the keyboard 12, an upper casing 17 is mounted on the lower casing 11. The upper casing 17 has housed therein mechanical parts and an optical system, and the front of the casing 17 has attached thereto a screen 18 for providing a display of printed information. Immediately below the screen 18, there is provided a cover 19, which can be opened by operating its knob 21 for mounting a recording medium on supporting means, or removing therefrom the recording medium.

Figure 2:
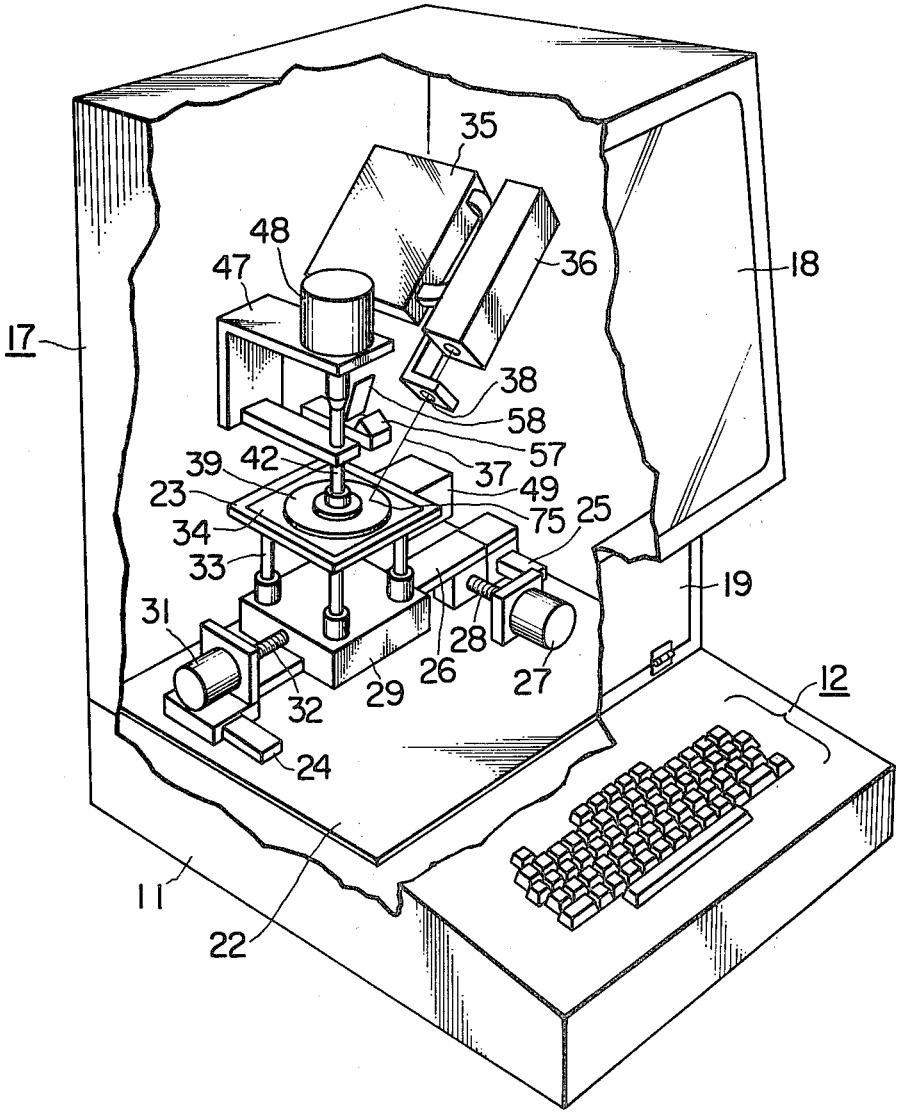
FIG. 2 is a perspective view schematically illustrating one part of the interval state of the microfilm typewriter of FIG. 1, with one part of its upper casing cut away.

As shown in FIG. 2, in the upper casing 17, its fixed base plate 22 forms the border with the lower casing 11 and a recording medium support plate 23 is mounted on the fixed base plate 22 in a manner to be freely movable in the X-direction, i.e., a lateral direction, and in the Y-direction, i.e., backward and forward directions. That is, rails 24 and 25 are fixedly mounted on the fixed base plate 22 to extend adjacent and along its left and right margins, respectively, and a movable rail 26 is mounted on the rails 24 and 25. A Y-direction drive motor 27 is secured to the fixed base plate 22, with its shaft held in parallel to the rail 25, and a lead screw 28 is attached to one end of the shaft in its lengthwise direction. The lead screw 28 is screwed into a threaded hole formed in the movable rail 26 to extend therein at right angles thereto. Accordingly, rotation of the motor 27 causes the movable rail 26 to move back and forth, that is, in the Y-direction. A movable bed 29 is mounted on the movable rail 26 in a manner to be freely movable thereon, and an X-direction drive motor 31 is attached to one end of the movable rail 26. A lead screw 32 affixed on the shaft of the motor 31 in its lengthwise direction is screwed into a threaded hole formed in the movable bed 29 to extend therein in parallel with the movable rail 26. Accordingly, rotation of the motor 31 drives the movable bed 29 in the X-direction.

On a plurality of struts 33 planted on the movable bed 29 is fixedly mounted the recording medium support plate 23. A recording medium 34 is removably mounted on the support plate 23. The recording medium 34 is one that a thin layer of a dispersion imaging material is formed on a substrate, and may be such as disclosed, for example, in British Pat. No. 1,402,760, entitled "Method for Producing Images". The abovesaid dispersion imaging material is one that upon application of radiant energy above a certain critical threshold value, a solid, continuous thin layer of the material in regions exposed to the radiant energy evaporates, or fuse to disperse and become discontinuous, whereby to enable recording of images. In the case of evaporation, there is a fear of the resulting vapor adhering to a lens or mask to stain it, so that dispersion is preferred rather than evaporation. The choise of evaporation or dispersion is dependent upon the energy density applied to the imaging material.

Accordingly, the recording medium 34 has a certain threshold value and, only when exposed to light of energy density above the threshold value, disperses to change its optical density but, when exposed to light of energy density below the threshold value, does not undergo any changes. The dispersion imaging material for use in the recording medium is preferred to be a thin film of one of bismuth, lead, tellurium, tin, antimony and like relatively low melting point metallic elements, or an alloy of them. This thin film has a thickness of about 100 to about 2000 Å, preferable 150 to 800 Å. With a thickness smaller than about 100 Å, it is difficult to obtain a record of sufficient contrast and a thickness larger than about 2000 Å requires large energy for printing and results in a difficulty in obtaining a record of high resolution. The recording medium 34 having a film of such a dispersion imaging material is produced by forming the abovesaid dispersion imaging material on a transparent substrate such as a polyester film, cellulose acetate film or like high molecular film, or glass, by means of, for example, vacuum evaporation, sputtering or the like. In the recording medium 34, images are formed solely by the application of optical energy to the medium 34 and no development step is required. Further, the recording medium may be improved, for instance, by forming a protective layer, as long as it does not depart from the gist described above.

The recording medium 34 may be held in position on the support plate 23, for example, by inserting pins on the support plate 23 into small holes formed in the recording medium 34 at its corners to thereby define its position, or by aligning a corner of the recording medium 34 with a position defining reference line on the support plate 23. Further, the recording medium 34 can be removably held, for instance, by a resilient clip secured to the support plate 23.

Figure 3:
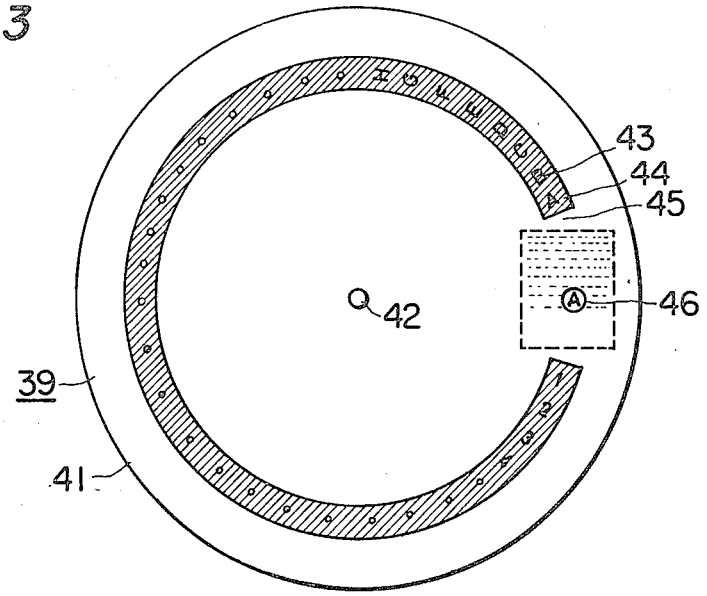
FIG. 3 is a plan view showing one example of an optical mask.

The recording medium 34 is irradiated by light converted into a character pattern designated by a key operation of the keyboard 12. A printing light source 36 is secured to the upper part of the rear panel of the upper casing 17 through a bracket 35, and a printing light 37 from the light source 36 is focused by a condenser lens 38 to irradiate the recording medium 34. An optical mask 39 is disposed adjacent the recording medium 34. The optical mask 39 is such, for example, as shown in FIG. 3, in which character patterns 43 are arranged concentrically about a central shaft 42 of a transparent disk 41 at equiangular intervals. The character patterns 43 are transparent and their backgrounds are opaque and the opaque portions 44 are formed unitary in the shape of an annular band. The circle of arrangement of the character patterns 43 includes a transparent part 45 for indication which is wider than the length of the page under the printing. The transparent disk 41 is formed, for instance, of glass. The annular opaque portion 44 is formed by evaporation of chromium or the like to a uniform thickness of about 30 Å to about 1 μm, preferably about 200 to about 2000 Å and is selectively removed by photoetching to form the character patterns 43. Accordingly, the optical mask 39 is a negative mask. The transparent portion 45 has a centrally disposed index 46 indicative of a printing position midway between both ends of the opaque portion 44, and the index 46 is shown in the form of a circle a little larger than one character pattern in the illustrated example.

As shown in FIG. 2, the central shaft 42 of the optical mask 39 vertically extends through confronting jaws of a U-shaped bracket 47 secured to the rear panel of the upper casing 17, and is coupled with the rotary shaft of a motor 48 mounted on the upper arm of the U-shaped bracket 47. The rotational angle of the optical mask 39 is normally held so that the index 46 indicative of the printing position may be irradiated by the printing light 37. During printing, the optical mask 39 is rotated by the motor 48 through a predetermined angle in accordance with an instruction from the keyboard 12, and when the pattern of the character selected has been brought to the printing light irradiating position, the optical mask 39 is stopped and then the printing light irradiates the selected character pattern, so that the light passing through the pattern is converted into the character pattern and reaches the recording medium 34 to achieve printing.

The printing light source 36 is preferred to be a pulse light source such as a xenon flash lamp, or a light source of a large energy density such as laser or the like, and especially laser is preferred because laser light has the property of going straight on. The laser is a solid-state laser such, for example, as a ruby laser, Nd:glass laser, Nd:YAG laser or the like, or a gas-state laser such as an He-Ne laser, Ar laser, $CO_2$-laser or the like.

When one character has been printed in the abovesaid manner, the recording medium 34 is moved, for instance, laterally to be ready for the next character printing. In this case, it is necessary to move the recording medium 34 and the printing light irradiating position relative to each other with high accuracy sufficient to record very small characters on the recording medium 34 at predetermined intervals without overlapping of the characters printed. This requires a high precision mechanism. But accurate positioning with an error less than 1 μm can be achieved by controlling the motors 27 and 31 utilizing, for example, optically reading means and a servo system which are used for masking in the manufacture of semiconductor integrated circuits. Recently, an accurate step motor whose rotational angle of one step is about 0.6° is available and, by using such a step motor as each of the motors 27 and 31, the recording medium 34 can be moved little in a digital manner.

Figure 4:
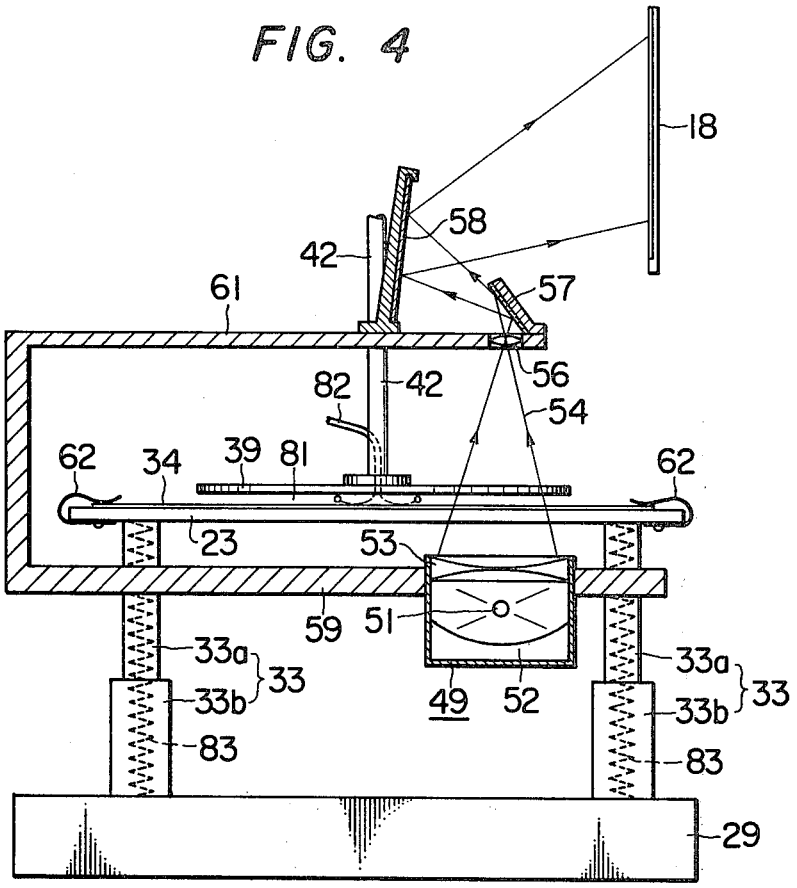
FIG. 4 is a side view showing a read-out optical system used in the microfilm typewriter of FIG. 1.

The character printed on the recording medium 34 as described above is optically projected and displayed, with the recording medium 34 retained on the support plate 23. This can be achieved by the employment of projecting and display means of the same system as a micro-character reading device used in an ordinary microfilm reader. For example, as schematically shown in FIG. 4, a readout light source 49 is disposed under the support plate 23 in opposing relation to the transparent portion 45 of the optical mask 39 includes a lamp 51 disposed in its case and light from the lamp 51 is focused by a reflector 52 and a condenser lens 53, and applied as a read-out light 54 to the recording medium 34 through the transparent support plate 23. The recording medium 34 is divided into a plurality of regions in the form of a matrix, and one of the regions, that is, one page (one frame), is irradiated over the entire area thereof by the read-out light, the irradiated region being aligned with the transparent portion 45 of the optical mask 39 lying in its normal position. The read-out light 54 having passed through the recording medium 34 and the optical mask 39 is projected onto the screen 18 through a projector lens 56, a reflector 57 and another reflector 58, thus providing a magnified or enlarged display of the printed character. The read-out light source 49 is secured to a mounting plate 59 in such a manner as to be interlocked with the recording medium 34, the plate 59 being carried by the struts 33 near their upper ends. One end portion of the plate 59 is bent to extend upwardly and then bent over to form a support arm 61. The support arm 61 is opposite to the transparent portion 45 and carries the projector lens 56 together with the reflectors 57 and 58. On the marginal portion of the support plate 23, there are provided a plurality of resilient clips 62, by means of which the recording medium 34 is removably held on the support plate 23.

With such an arrangement, upon designating a character by selecting a desired one of the keys of the keyboard 12, the optical mask 39 rotates to bring the pattern of the designated character to the printing light irradiating position, and stopped. Then, irradiation by the printing light takes place to print the character pattern on the recording medium 34. Next, the recording medium support plate 23 moves a distance corresponding to one character for the next printing. Accordingly, characters can be printed one by one. On top of that, during printing the printed portions and the neighboring areas on the recoding medium 34 are successively displayed on the screen 18 on an enlarged scale.

Figure 5:
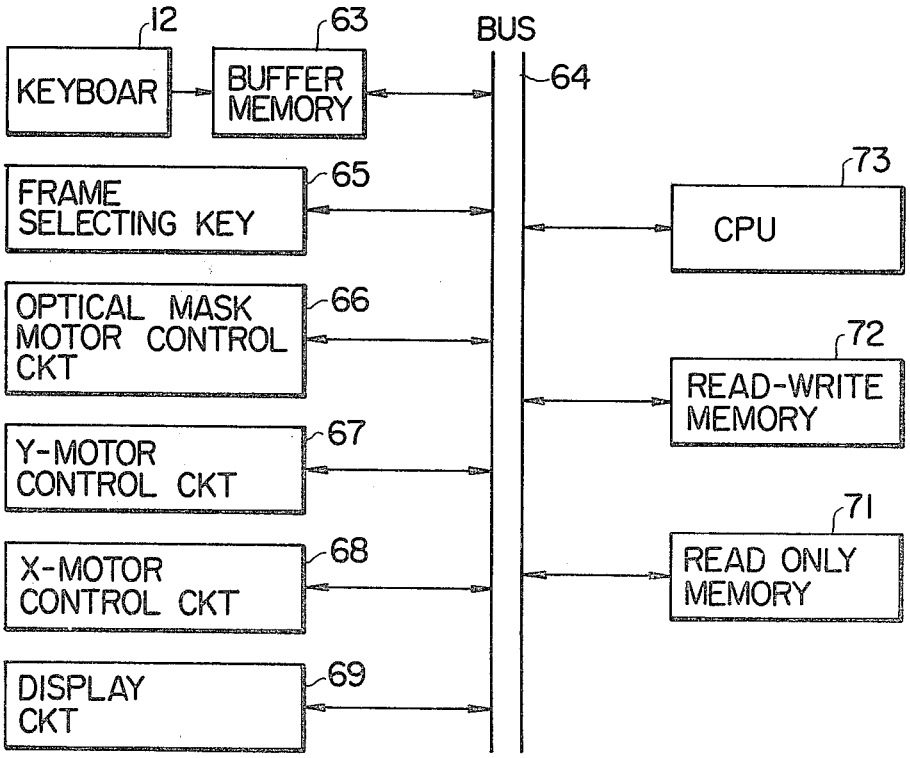
FIG. 5 is a block diagram systematically illustrating an electric circuit part of the microfilm typewriter of FIG. 1.

An electrical control for achieving such operations as mentioned above can readily be effected by a program control through the use of a simple processing unit commonly called microcomputer. For example, as shown in FIG. 5, input data as by the character key of the keyboard 12 is temporarily stored in a buffer memory 63 having a storage capacity of, for instance, 100 words, and the input data read out therefrom is supplied to a bus 64. Further, input data from a key 65 for selecting the frame (page) of the recording medium 34 in which printing takes place, is directly supplied to the bus 64. This frame selecting key 65 is disposed on the keyboard 12. The bus 64 has connected thereto a control circuit 66 for the motor 48 for rotating the optical mask 39, a Y-direction control circuit 67 for the motor 27 for moving the recording medium support plate 23 in the Y-direction, an X-direction control circuit 68 for the motor 31 for shifting the support plate 23 in the X-direction, and a display circuit 69 for providing various displays such as completion of preparation, completion of printing, etc. Moreover, the bus 64 has connected thereto a read-only memory 71 having stored therein various programs necessary for the control of the microfilm typewriter, a read-write memory 72, for example, a random access memory, for use as a primary storage, a counter and a delay line memory which are necessary for the execution of the programs and a central processing unit 73 which performs operations and various gate controls necessary to read out the programs for the execution thereof.

Figure 6A:
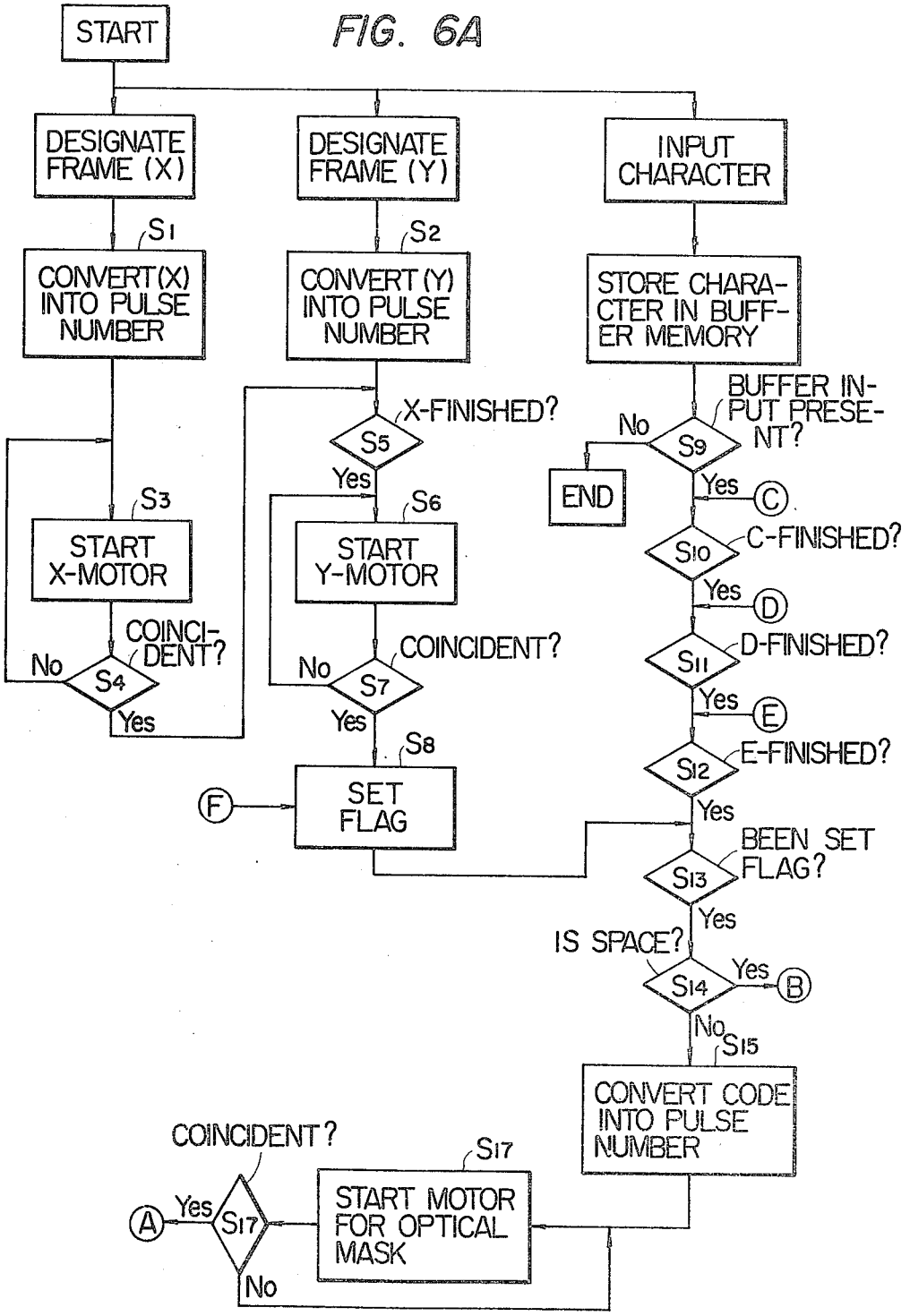

The processing by the above program control is executed, for instance, in accordance with a flow chart shown in FIGS. 6A and 6B. The control programs stored in the memory 71 are so prepared as to achieve such operations. Upon turning on the power source switch, all parts of the microfilm typewriter are put in their initial state and the support 23 is also placed at its reference position, for instance, a position where the region for printing a first character of a first line on a first page (a first frame) of the recording medium 34 lies at the printing light irradiating position. At first, the operator achieves by key operations X- and Y-direction frame designations for deciding the frame of the recording medium 34 in which printing takes place. Then, the character to be printed is designated. The X- and Y-direction frame designations are written in the central processing unit 73 and then, in number-of-pulses conversion steps $S_1$ and $S_2$, the abovesaid frame designations are respectively converted into pulses which are applied to the X- and Y-direction motors, respectively. In a step $S_3$, the X-direction motor 31 is started and, in the next step $S_4$, it is checked whether or not the number of steps of rotation of the motor 31 is coincident with the converted number of pulses obtained in the step $S_1$. When they are coincident with each other, the X-direction motor 31 is stopped and this is verified in a step $S_5$ and then the Y-direction motor 27 is started in a step $S_6$. In a step $S_7$, it is checked whether or not the number of steps of rotation of the motor 27 is coincident with the converted number of pulses obtained in the step $S_2$, and if they are coincident with each other, the motor 27 is stopped. In the following step $S_8$, a flag indicative of completion of the frame selection is provided.

On the other hand, the input data as of the character selected is stored in the buffer memory 63 and, in a step $S_9$, it is checked whether the buffer memory 63 stores the data or not. Where the data exists in the buffer memory 63, it is confirmed in a step $S_{10}$ that the optical mask 39 has returned to its reference position. Then, in a step $S_{11}$, it is affirmed that the recording medium 34 has shifted by a distance of one character in the X-direction after printing. Further, in a step $S_{12}$, it is confirmed whether a line feed of the recording medium 34 has already been effected or not, and in a step $S_{13}$ it is affirmed that the flag indicative of completion of the frame selection has been provided. Thereafter, in a step $S_{14}$, it is checked whether the inputted data is the spacing or a character. In the case of a character, the character code is converted into the number of pulses indicative of the standard position of the character pattern in a step $S_{15}$, after which the motor 48 is started in a step $S_{16}$. In the subsequent step $S_{17}$, it is checked whether the number of steps of rotation of the motor 48 is coincident with the number of pulses obtained in the step $S_{15}$, and in the case of coincidence, the motor 48 is stopped. At this time, the character pattern of the character designated by the key operation is placed at the printing light irradiating position. In order to bring the optical mask 39 to a standstill completely, the printing light source 36 is delayed, for instance, for about 0.01 to about 1 second in a step $S_{18}$, and then triggered in a step $S_{19}$. As a result of this, the designated character is printed in the recording medium 34. In consideration of a delay of laser light in its starting, the operation of the next step is delayed for about 10 milliseconds in a step $S_{20}$ and, in the next step $S_{21}$, the numerical value converted in the step $S_{15}$ is set, which is followed by the step $S_{22}$ in which the optical mask driving motor 48 is revolved in the direction opposite to that in the case of the preceding character pattern selection. In a step $S_{23}$, it is checked whether the set value and the number of steps of rotation coincident with each other or not and, in the case of coincidence, the motor 48 is stopped. At this time, the reference position of the optical mask 39, that is, the index 46, is brought to the position of irradiation by the printing light 37. Further, a return signal for the optical mask 39 is applied to the step $S_{10}$.

After printing in the step $S_{19}$, "1" is added to a character counter in a step $S_{24}$. The character counter is held at "0" in its initial state, and provided to count the number of characters printed in one line. In the step $S_{25}$, it is checked whether the count value N of the character counter is smaller than a predetermined value, for example, 30 or not. The value N smaller than 30 indicates that printing is still possible in the line in which characters are being printed. In this case, in a step $S_{26}$, and X counter, which indicative of the position of the recording medium 34 in the X-direction with respect to the printing light irradiating position, is added with one step, and in a step $S_{27}$, the X-direction motor 31 is started. And, in a step $S_{28}$, it is checked whether the count value of a counter for counting the number of steps of rotation of the motor 31 is coincident with the count value of the X counter or not, and if they are coincident with each other, the X-direction motor 31 is stopped. In other words, the recording medium 34 moves by a distance of one character in the X-direction, and then stops. A stop confirming signal is applied to the step $S_{11}$. Consequently, if data is present in the buffer memory 63, it is read out. The printing operation described above is repeatedly carried out.

Upon completion of printing of one line in this manner, it is detected that the count value N of the character counter has reached the predetermined value 30 in the step $S_{25}$. And, in a step $S_{29}$, the X counter is reset to a predetermined value, for example, and the operation proceeds to a step $S_{27}$, starting the X-direction motor 31 in the reverse direction to bring the printing light irradiating position to the beginning of the line of the frame. Further, in a step $S_{30}$, the character counter is reset to "0" and, in the next step $S_{31}$, the Y counter is advanced by one step and, in the following step $S_{32}$, the Y-direction motor 27 is started. In a step $S_{33}$, it is checked whether the count value of a counter for counting the number of steps of rotation of the Y-direction motor 27 and the count value of the Y counter is coincident with each other or not. In the case of coincidence, the motor 27 is stopped, that is, the recording medium 34 is shifted by one line in the Y-direction to perform the line feed operation, and a stop confirming signal is fed to the step $S_{12}$. Where data is present in the buffer memory 63, printing takes place from the beginning of the next line of the selected frame of the recording medium 34. After the Y counter is advanced in the step $S_{31}$, "1" is added to the content M of a line counter in a step $S_{34}$. In the next step $S_{35}$, it is checked whether or not the content of the line counter has reached a predetermined value, that is, the number of lines of one frame, for example, 31. Where the content of the line counter has already reached the above-said value 31, the flag in the step $S_8$ is reset and the printing operation is stopped. The state of this flag is indicated, for instance, by a lamp on the Key Board 12. The operator recognizes completion of printing in one frame from the indication by the lamp, and then performs the next frame selecting operation. It is also possible to make a program so that the frame selection may also be automatically achieved. Upon detection in the step $S_{11}$ that all the data has been read out from the buffer memory 61, the printing operation is completed.

Where it is detected in the step $S_{14}$ that the data is indicative of spacing, the operation proceeds to the step $S_{24}$, in which "1" is added to the content of the character counter and, without triggering the printing light source, the recording medium 34 is driven in the same manner as in the case of one character having been printed. For continuous forward movement of the recording medium 34 in the X-direction, a forward key is pushed. Upon detection of this in a step $S_{36}$, "1" is added to the content N of the character counter in a step $S_{37}$ and "1" is added to the X-direction counter in a step $S_{38}$. Thereafter, the operation interrupts in the step $S_{27}$, in which the recording medium 34 is moved forward by one character in the X-direction and while the forward key is pressed, the above is repeated, that is, the recording medium 34 keeps on moving forward in the X-direction. When it is detected that a backward key is pushed in a step $S_{39}$, "1" is subtracted from the content N of the character counter in a step $S_{40}$ and "1" is subtracted also from the content of the X-direction counter in a step $S_{41}$, and the operation interrupts in the step $S_{27}$, with the result that while the backward key is pressed, the recording medium 34 is moved back in the X-direction.

Upon depression of the carriage return key, it is detected in a step $S_{42}$ and the X counter is reset at its predetermined position in a step $S_{29}$, the character counter is reset to "0" in a step $S_{30}$, the Y counter is advanced by one step in a step $S_{31}$, "1" is added to the content M of the line counter in a step $S_{34}$, whereby the recording medium 34 is moved forward by one line in the Y-direction. Upon detection of depression of the carriage back key, in a step $S_{43}$, "1" is subtracted from the content M of the line counter in a step $S_{44}$ and "1" is subtracted also from the content of the Y counter in a step $S_{45}$, and the operation interrupts in the step $S_{32}$, so that the recording medium 34 is moved back by one line.

It is preferred that even when the optical mask 39 has been rotated to bring the selected character pattern to the printing light irradiating position, the opaque portion 44 does not disturb the read-out operation. One way to minimize the influence of the optical mask on the read out of printed character is to select the optical density of the opaque portion 44 to range from about 0.1 to about 1.0 preferably in the range from about 0.2 to about 0.6. The optical density mentioned herein is the value measured by using Macbeth Transmission Densitiometer TD-500 in accordance with the definition of ASH PH2. 19-1959. The opaque portion 44 having the optical density of about 0.1 to about 1.0 can be produced by depositing chromium on a glass plate to a thickness of about 30 to about 300 Å by means of evaporation, for example. Where the optical density is lower than about 0.1, if the radiation intensity of the printing light source 36 is not uniform, or if the radiation intensity of the light source 36 differs with each radiation, the information printed on the recording medium 34 through the character pattern of the optical mask 39 is difficult of visual interpretation because of a small difference in the optical density between the opaque portion 44 and the character pattern 43. Conversely, if the optical density is higher than about 1.0, when the information printed on the recording medium 34 is read by the light transmitting through the optical mask 39, the light from the read-out light source 49 is almost absorbed by the opaque portion 44, with result that the magnified image projected onto the screen 18 becomes dark.

Figure 7:
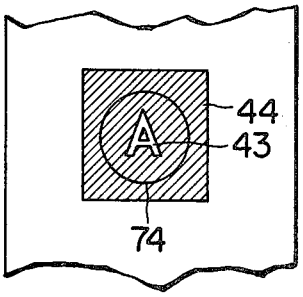
FIG. 7 is a diagram illustrating one part of the optical mask.

Another way to minimize the influence of the optical mask on the read out of the printed character is to limit the background of the character of the optical mask. As illustrated in FIG. 7, the opaque portion 44, which is the background of the character pattern 43, is formed so that its area is about 2 to about 100 times that of the character pattern, preferably about 5 to about 20 times, and larger than the spot size 74 of the light from the printing light source 36, which the other remaining portion transparent, thus providing a negative mask.

One of the features of the microfilm typewriter of this invention resides in that the character printed can be immediately read. In the case where the components of the reading means and the recording medium 34 are interlocked with each other as set forth previously in connection with FIG. 4, the entire mechanism can be formed small in size. For successively printing characters on the recording medium 34, it is necessary to successively shift the irradiating position of the printing medium 34. This can be accomplished by a method of shifting in succession the projecting light irradiating position relative to the recording medium 34 fixed, or a method of successively moving the recording medium 34 relative to the projecting light irradiating position fixed. With the former method, it is necessary to move the light source 36 and, in some cases, together with the condenser lens 38, the optical mask 39, etc., so that the drive system therefor becomes large-scaled to introduce a difficulty in speeding up of the operation and, further, a play is caused by vibrations or the like, making the long-time use of the apparatus and accurate position control difficult. On the other hand, the latter method can be achieved by driving only the recording medium 34 or the support plate 23 therefor, and hence has the merit that more accurate position control can be readily accomplished by the employment of a smaller drive system. With this latter method, however, when the character printed on the recording medium 34 is projected, the recording medium 34 is moved relative to the read-out optical system at each character printing, and accordingly there is the possibility of the image projected onto the screen 18 becoming gradually shifted so that the principal part of the image finally gets out of the screen 18. Therefore, the screen 18 is required to be very large. This increases the cost of the screen and increases makes the entire apparatus very bulky and since the image displayed on the screen 18 is shifted at each printing, there still remains the problem of difficult interpretation of the display.

Figure 8:
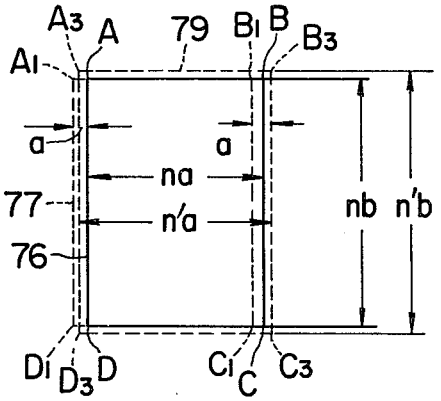
FIG. 8 is a diagram showing the movement of an image on a screen in the case where the read-out optical system and a recording medium are interlocked with each other.

To avoid such problems, the read-out optical system is adapted to move in association with the movement of the recording medium 34. In FIG. 4, after one character is printed, the recording medium support plate 23 is driven a distance of about one character in a direction vertical to the plane of the sheet, that is, in the X-direction in FIG. 2, thereby to bring a new blank part of the recording medium 34 to the printing position 75 where the printing light 37 is irradiated. When the recording medium 34 moves, the optical system of the read-out light source 49 also moves in the same manner, so that their relative positions remain unchanged. Upon completion of printing characters in one line, a line feed takes place and then characters are successively printed in the next new line. Thus, characters are printed line by line in one page (one frame). FIG. 8 shows the state of the projected image appearing on the screen 18 in the above process. In FIG. 8, reference character a indicates the length of one line of one page (i.e., the length in the lateral direction) on the recording medium 34, and b designates the length of the page in the vertical direction. A rectangle 76 defined by angles A, B, C and D indicates the projected image on the screen 18 at the first position of one page in which characters are to be printed. If the magnifying power of the read-out optical system is taken as a, the lengths of segments $\overline{AB}$ and $\overline{CD}$ are both equal to na and the lengths of segments $\overline{AD}$ and $\overline{BC}$ are both equal to nb. At first, the printing position lines at a point A and, upon printing a character at this point, the recording medium 34 is driven a distance of about one character in the direction vertical to the plane of the sheet in FIG. 4. When this operation has been successively repeated to the end of the first line, the projected image of this page becomes such a rectangle 77 as indicated by ABCD which is deviated by a distance a in the lateral direction. Thus, the image projected onto the screen 18 is deviated only 1/n of the entire image.

Figure 9:
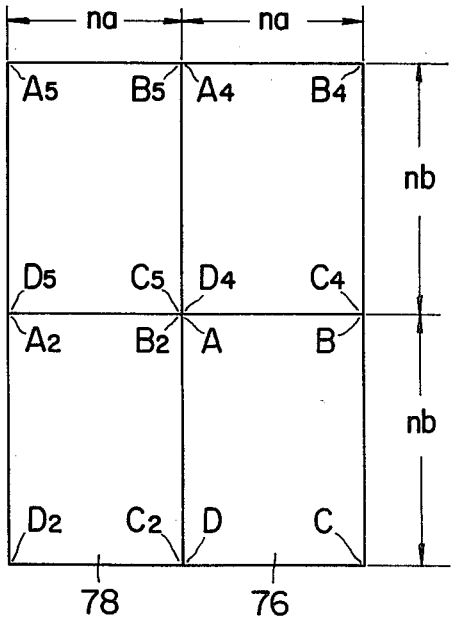
FIG. 9 is a diagram, similar to FIG. 8, showing the movement of the image on the screen in the case where the read-out optical system and the recording medium are not interlocked with each other.

However, if theread-out optical system is fixed without being interlocked with the movement of the recording medium 34, the projected image 76 of the first page on the screen 18 becomes a rectangular image 76 such as defined by $A_2B_2C_2D_2$ in FIG. 9 which is deviated a distance na in the lateral direction. It will be seen that the deviation of the image is equal to the size of the entire image. Accordingly, if the read-out optical system is arranged to move in association with the recording medium 34, the more the magnifying power n increases, the smaller the screen becomes, as compared with that in the case where the read-out optical system is not associated with the recording medium 34. The magnifying power employed in the microfilm read-out system is usually more than 10 times, and a very great effect is produced by the abovesaid interlocking arrangement.

When the line feed has been achieved line by line to bring the printing position to the beginning of the last line, the recording medium 34 moves by a distance b to left in FIG. 4. At this time, where the read-out optical system is interlocked with the recording medium 34, the read-out optical system also moves by the distance b to left along with the recording medium 34, so that the magnifying power of the read-out optical system increases a little. If the magnifying power at this time is taken as n', the projected image becomes a rectangle 79 defined by $A_3B_3C_3D_3$ in FIG. 8. Here, segments $\overline{A_3B_3}$ and $\overline{C_3D_3}$ are both equal to n'a, and segments $\overline{A_3D_3}$ and $\overline{B_3C_3}$ are both equal to n'b. If the distance from the projector lens 56 to the screen 18 through the reflectors 57 and 58 is taken as s+b, the variation in the magnifying power is given by the following formula:

$$n'/n = (s+b)/s = 1 + b/s \quad (1)$$

As is seen from the above, the magnifying power varies in such a ratio that the distance of movement of the recording medium is divided by the distance of projection from the projector lens 56 to the screen 18. In general, however, the abovesaid value is small. Assuming that the distance of movement of the recording medium 34 is, for example, 1 cm and that the distance of projection is 50 cm, the change in the magnifying power is about 1/50, which does not any problem in practical use. Where the read-out optical system is not interlocked with the recording medium 34, the upper left-hand end of the page which lies initially at the position A in FIG. 9 shifts to a point $A_2$, $A_4$ or $A_5$ during the printing operation of a whole page. Accordingly, in such a case where the read-out optical system is not arranged to move with the recording medium 34, the projected image on the screen is gradually shifted, and hence is difficult to read. Further, in order that the projected image on the screen may be read anytime during the printing operation of a whole page, it is necessary that the screen 18 covers a rectangular area defined by $A_5B_4$ $CD_2$ in FIG. 9 and that the read-out light source 49 is large enough to allow deviation of the recording medium 34 with respect to the light source 49. On the other hand, where the read-out light source 49 is designed to move in association with the recording medium 34, the projected image on the screen always remains substantially at a standstill, and hence is easy to read, and the light source 49 and the screen 18 can be made far smaller than in the case where the former is not interlocked with the latter. In some cases, one or both of the reflectors 57 and 58 of the read-out optical system may be left out, or more reflectors may also be provided, and all of these reflectors need not always be interlocked with the recording medium 34. The screen 18 might be said to be one of the elements of the read-out optical system, but need not be constructed to move in association with the other elements of the read-out optical system. In FIG. 4, the magnifying power undergoes a very small variation with the movement of the read out optical system and the positional deviation of the projected image is also very small, and these do not present any problems in ordinary use. However, for example, in the case where the reflectors 57 and 58 are not provided, or where the reflector 57 forms an angle of 45° to the recording medium 34 and is not adapted to move in association with the latter, the distance from the projector lens 56 to the screen 18 remains unchanged, so that the magnifying power does not ever change. Accordingly, in the case where a slight change in the magnifying power presents a serious problem, such a read-out optical system should not be used.

Generally, it is preferred to hold the optical mask 39 and the recording medium 34 in close contact with each other because the printing light 37 reaches the recording medium 34 without deforming the character pattern. However, if the optical mask 39 and the recording medium 34 are in close contact with each other, friction between them inflicts injury on them when the optical mask 39 is driven, or a large power is required for driving them and the printing speed cannot also be increased. But even where a gap of less than about 2 mm is formed between the recording medium 34 and the character pattern forming surface of the optical mask 39, excellent printing can be accomplished by the employment of a laser as the printing light source 36. In the event that transfer printing of a character pattern is achieved by using, as the printing light source 36, for example, a Xenon flash lamp 8 mm in diameter and 40 mm in length, and disposed at a distance of about 10 mm apart from the printing position, if the gap between the optical mask 39 and the recording medium 34 exceeds about 20 μm, the printed micro character is appreciably deformed and indistinct even in the case of a relatively large character pattern with a side 150 μm long. Further, even if a laser light having substantially parallel rays is used as the printing light source 36, when the gap between the recording medium 34 and the character pattern forming surface of the optical mask 39 is large, for example, 1 cm, distinct micro character transfer printing cannot also be achieved. However, it has been found that a distinct print can be obtained by using the laser light and disposing the recording medium 34 and the optical mask 39 with a gap therebetween in the range of about 5 μm to about 2 mm. When the gap 81 between the recording medium 34 and the character pattern forming surface of the optical mask 39 is more than about 2 mm, distinct transfer printing of the character pattern formed on the optical mask 39 is difficult. With the gap 81 selected smaller than about 5 μm, the effect of providing the gap 81 is lessened and unevenness of the surfaces of the optical mask 39 and the recording medium 34, dust and so on make it difficult to prevent generation of friction between the optical mask 39 and the recording medium 34.

Although described in detail later on, the gap 81 can be provided between the recording medium 34 and the optical mask 39 in the following way: For example, a hole is formed in the optical mask 39 and air is blown out through the hole toward the recording medium 34 to cause the optical mask 39 and the recording medium 34 to repulse each other, and the optical mask 39 and the recording medium 34 are each pressed toward the other as by springs to balance their forces, thus providing a constant gap. With this method, the magnitude of the gap 81 can easily be adjusted by controlling the amount of air blown out through the hole formed in the optical mask 39 and, further since a layer of air exists between the optical mask 39 and the recording medium 34, they do not make direct contact with each other, resulting in a merit that no friction is generated between them. Another method of forming the gap 81 between the character pattern forming surface of the optical mask 39 and the recording medium 34 is to form a thin layer of a material of a small coefficient of friction such, for example, as Teflon, over the entire area or one part of the surface of the optical mask 39 except its character patterns, thereby to reduce the contact area of the optical mask 39 with the recording medium 34 or decrease friction between them.

Referring now to FIG. 4, a preferred example of providing the gap 81 between the recording medium 34 and the character pattern forming surface of the optical mask 39 will be described. For example, a hollow shaft is used as the central shaft 42 of the optical mask 39 and an air supply pipe 82 of a flexible material is inserted into the shaft 42 through a hole formed in its intermediate portion, and then air is blasted against the recording medium 34 through the shaft 42 to separate the recording medium 34 from the optical mask 39. On the other hand, the struts 33 carrying the recording medium support plate 23 are each telescopically formed with two pipes **33*a* and 33*b* and a coiled spring 83 is inserted into each strut 33, by which the recording medium 34 is pushed up through the support plate 23 to approach the optical mask 39. By suitably balancing the forces of separating the recording medium 34 from the optical mask 39 and approaching the former to the latter, the magnitude of the gap 81** can be held appropriately.

Figure 10:
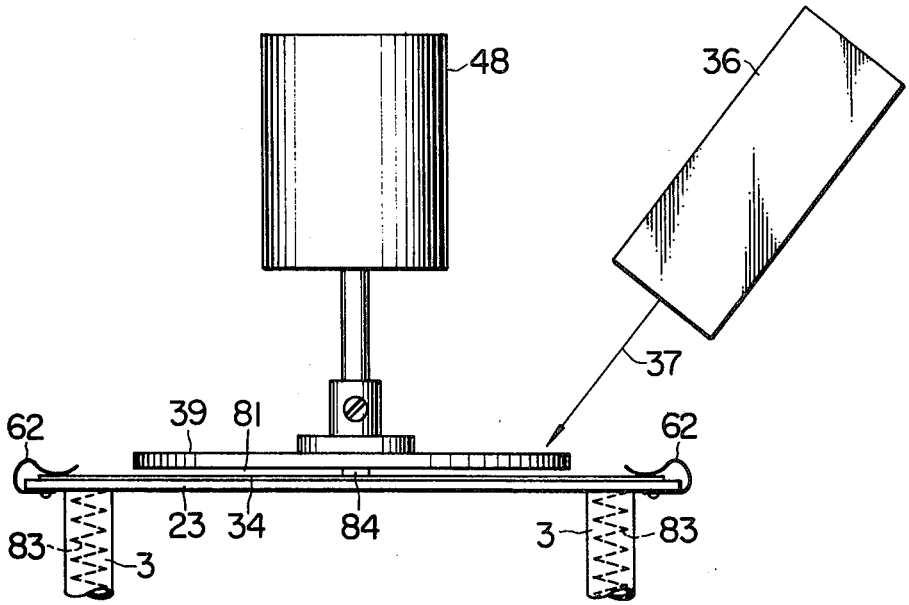
FIG. 10 is a diagram illustrating an example in which a spacer is used for forming a gap between the optical mask and the recording medium.

FIG. 10 schematically illustrates another example of the means for providing the gap 81 between the optical mask 39 and the recording medium 34. A spacer 84 is interposed between the optical mask 39 and the recording medium 34 at the central portion of the former. The spacer 84 is formed of a high molecular substance such as fluoric resin, nylon, polyethylene or the like, an inorganic substance such as glass, metal or the like. But it is especially preferred to use the fluoric resin. The spacer 84 is formed to cover only the central portion of the optical mask 39, by which resistance due to friction between the mask 39 and the recording medium 34 is reduced when the former is rotated, and the character patterns of the optical mask 39 are held apart from the recording medium 34. In FIGS. 4 and 10, the force of the springs 83 are employed for pushing up the recording medium 34, but it is also possible to utilize, an air pressure, magnetic force or electrostatic force.

Especially preferred means for providing the gap 81 between the recording medium 34 and the optical mask 39 is one that utilizes a gas (fluid) pressure not only for blowing a pressurized gas between the optical mask 39 and the recording medium 34 but also for urging the latter toward the former. By using this preferred means for projecting the gap 81 between the recording medium 34 and the optical mask 39, the recording medium 34 can be easily mounted on the support plate 23 and removed therefrom, and there is no possibility of damaging the recording medium 34 and the optical mask 39 by inadvertent contact of them with each other when the recording medium 34 is mounted on the support plate 23 or removed therefrom. Further, even if the recording medium 34 is not completely flat, there is no likelihood that one part of the recording medium 34 makes direct contact with the optical mask 39 to damage each other.

Figure 11:
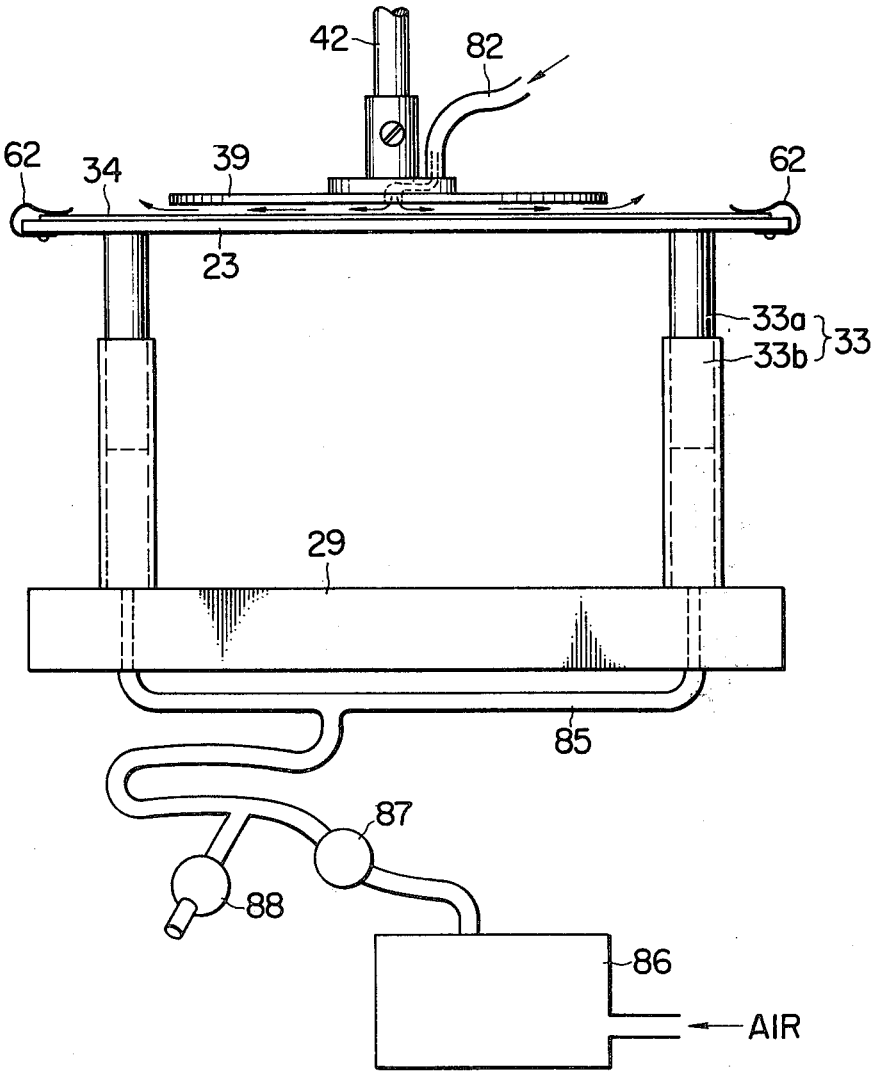
FIG. 11 is a diagram showing an example in which a gas pressure is used for forming a gap between the optical mask and the recording medium.

An example of such a preferred method is shown in FIG. 11. Also in this case, pressurized air is blown against the recording medium 34 from the center of the optical mask 39 through the flexible pipe 82, as is the case with FIG. 4. On the other hand, the struts 33 carrying the recording medium support plate 23 are each composed of a rod 33*a* and a cylinder 33*b* telescopically receiving it, and air is supplied to the cylinder 33*b* from a pressure tank 86 through a flexible tube 85. A valve 87 is provided at the coupling portion between the tube 85 and the tank 86 and an exhaust valve 88 is coupled to the valve 87 on the side of the tube 85. The air in the air tank 85 is supplied to the cylinder 33*b* through the tube 85 to press the recording medium 34 toward the optical mask 39. By suitable regulation of the flow rate of air blown out from the optical mask 39 or the pressure of the pressure tank 86 for blowing air into the cylinder 33*b*, the gap 81 between the optical mask 39 and the recording medium 34 can easily be controlled. The pipe 82 is flexible, and hence does not disturb the rotation of the optical mask 39. Likewise, the tube 85 is also flexible, and hence does not hinder the movement of the movable bed 29. Since the optical mask 39 need not make one revolution, there is no possibility of the pipe 82 coiling itself around the shaft 42.

Another advantage of the present microfilm typewriter lies in that the recording medium 34 can easily be mounted on the support plate 23 and removed therefrom. It is ideal that printing is achieved with the very small gap 81 defined between the optical mask 39 and the recording medium 34, as described above. But if the optical mask 39 and the recording medium 34 are fixed in such a state, it is difficult to mount the recording medium 34 on the apparatus or remove therefrom the medium 34 and, in such a case, there is a fear that the recording medium 34 is contacted with the optical mask 39 to wear or damage them. However, in the case where the recording medium 34 is mounted on the support plate 23 or removed therefrom, for example, the exhaust valve 88 is opened to let air out of the cylinder 33*b*, so that the rods 33*a* carrying the recording medium support 23 descends to lower the recording medium 34. Consequently, the gap 81 between the recording medium 34 and the optical mask 39 becomes large to allow ease in mounting or removal of the recording medium 34. In the example shown in FIG. 11, since gravity is applied downwardly to the recording medium 34 and the support plate 23 therefor, when the air pump is stopped by power suspension or by some cause, the recording medium 34 naturally goes down to increase the gap 81 between the recording medium 34 and the optical mask 39, eliminating the possibility of the both making direct contact with each other to result in friction, wear or damage of them. Of course, the same effects can be obtained even in the case where the relative arrangement of the optical mask 39 and the recording medium 34 in the vertical direction is reversed and the optical mask 39 is pressed toward the recording medium 34. Further, where no gravity is utilized, for example, where the recording medium 34 is disposed in a vertical plane, it is also possible to always apply a weak force of separating the recording medium 34 from the optical mask 39 by utilizing spring force in place of gravity and approach the medium 34 to the optical mask 39. Moreover, in FIG. 11, air is blown out from one hole formed in the optical mask 39 in the vicinity of its center but the hole need not always be formed at the center of the mask 39 and more holes may be formed. For instance, a plurality of holes may be formed in desired positions except the area in which the character patterns are formed. In some cases, this arrangement is rather preferred from the viewpoint of maintaining the optical mask and the recording medium in parallel to each other.

Figure 12:
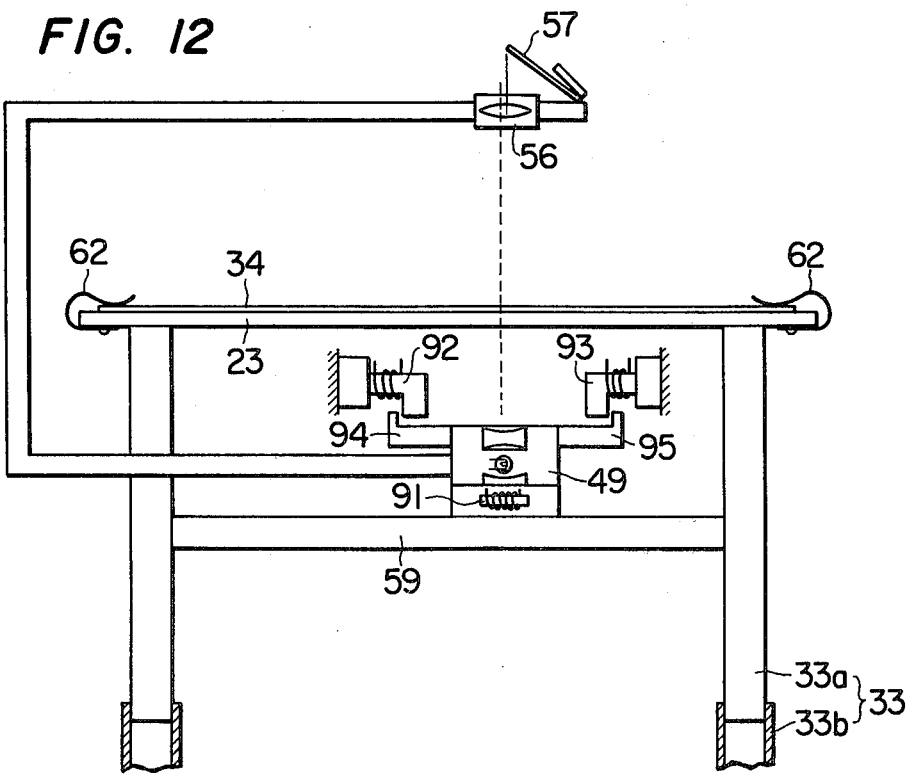
FIG. 12 is a diagram showing means for moving the read-out optical system and the recordng medium together or independently of each other.

In the case of selecting the page of the recording medium 34, the read-out optical system and the recording medium 34 are dissociated from each other and only the recording medium 34 is moved, with the read-out optical system fixed. FIG. 12 illustrates one example of such an arrangement. The plate 59 is formed of a magnetic material and an electromagnet 91 is disposed on the underside of the case of the read-out light source 49 and, during the printing operation, the electromagnet 91 is energized, by which the magnet 91 and the plate 59 are magnetically attracted to each other, and fixed. In the case of selecting the page of the recording medium 34, power supply to the electromagnet 91 is cut off and electromagnets 92 and 93 are energized to magnetically attract thereto magnetic pieces 94 and 95 fixed on the opposite sides of the read-out light source 49, thereby separating the read-out light source 49 from the plate 59.

Figure 13:
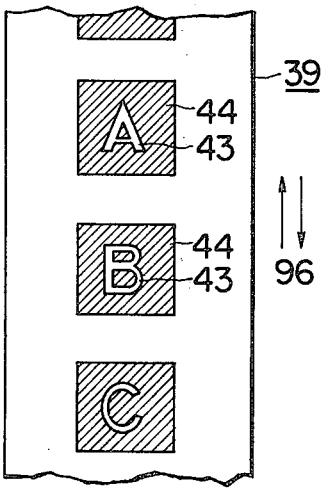
FIG. 13 is a diagram showing a modified form of the optical mask in which character patterns are aligned in a line.

In the optical mask 39, the opaque regions 44 of the character patterns 43 may each be separated from adjacent ones of them, as depicted in FIG. 13. Further, the character patterns 43 may be arranged not only in a circle but also in a straight line, as shown in FIG. 13. Where the character patterns are aligned in such a straight line, the optical mask is moved to and fro in the direction of arrangement of the character patterns, as indicated by the arrow 96, to bring a selected one of the character patterns to the printing light irradiating position for printing and, upon printing of each character pattern, the recording medium 34 is shifted by one character in a direction perpendicular to the direction of the arrow 96. Thus, the printed information is moved out of the opaque portion 44 and can be read and, further, by selecting the optical density of the opaque portion 44 as described previously, the part of the printed character overlapping the opaque portion 44 can also be read. In the case where the opaque portion 44 and the transparent portion are disposed alternately with each other in the direction of arrangement of the character patterns, as illustrated in FIG. 13, the transparent and opaque portions alternate with each other during movement of the optical mask 39 for the character pattern selection, so that the influence of the opaque portion 44 on the screen 18 can be eliminated by an after image effect. Also in the case where the character patterns 43 are aligned in a straight line, the opaque portions 44 may be formed integrally.

Further, the optical mask 39 has been described above to be a negative mask, in which case the read-out light is transmitted through the recording medium to project the printed pattern onto the screen. But the optical mask 39 may also be a positive mask which is opaque in the character pattern portions and transparent in the other portions, and in this case, the read-out light is reflected by the printed recording medium to project the reflected light onto the screen. However, brighter images can be obtained by the projection with the transmitted light more easily.

In the foregoing, the printing light is converted by the optical mask into a light of the character pattern, but it is also possible to divide the character pattern into a matrix of picture elements of, for example, 7 lines and 5 rows and to scan the surface of the matrix so that the picture element regions of the character pattern radiate.

With the microfilm typewriter according to this invention described above, micro characters are optically printed on the recording medium one by one and the printed images are immediately provided without any development process and, even during the printing of characters, the printed characters are magnified and displayed on the screen. This permits the operator to perform printing while making sure that printed characters are correct based on the display provided on the screen. Accordingly, it is also possible to add data to the recording medium on which data is being recorded. In the case where the index 46 indicative of the next printing position is provided on the optical mask 39, as shown in FIG. 3, the character to be printed next is displayed on the screen, so that when a character is additionally printed on the recording medium already printed, the additional character can be easily placed at its correct printing position. By selecting the optical density of the opaque portion of the optical mask or limitting the background of the character in the manner described previously, printed characters can be read on the screen without exerting an influence on the optical mask. Further, with the interlocking arrangement of the readout optical system and the recording medium, the screen and consequently the entire apparatus can be reduced in size and, in addition, a readable display can be obtained. Moreover, the provision of abovesaid small gap between the recording medium and the optical mask enables distinct printing without inflicting any injury to the recording medium and the optical mask.

It will be apparent that many modifications and variations may be effected without departing from the scope of novel concepts of this invention.

What is claimed is:

1. A microfilm typewriter comprising:

means for designating a character, numeral or symbol;

support means for supporting a recording medium having a layer of a dispersion imaging material formed on a substrate;

a printing light source for generating light of energy density high enough to cause a sufficient dispersion of the dispersion imaging material immediately to form an image without any development process when the light is applied to the recording medium;

an optical mask having formed thereon character, numeral and symbol patterns of a size in the range of about 20 to about 500 μm, which converts the light of the printing light source into a light of a pattern of the character, numeral or symbol designated by the designating means to irradiate the recording medium with the converted light of the character, numeral or symbol pattern, the size of the character, numeral or symbol pattern to achieve printing being in the range of about 20 to about 500 μm;

first means for moving the optical mask and the printing light source relative to each other to select and irradiate the designated character, numeral or symbol pattern with the light of the printing light source;

second means for moving the recording medium support means and the position of irradiating the recording medium with the converted light of the character, numeral or symbol pattern relative to each other with accuracy high enough to print characters, numerals or symbols one by one on the recording medium at predetermined positions; and projecting means for optically providing on a fixed screen a magnified display of the character, numeral or symbol printed on the recording medium in the neighborhood of the printing position during the printing operation, the projecting means including an optical system for applying a read-out light to a predetermined region including the printing position of the recording medium to project the character, numeral or symbol printing in the predetermined region to the fixed screen and means for interlocking the optical system with the movement of the second moving means.

2. The microfilm typewriter according to claim 1, which further includes means for dissociating the optical system from the interlocking means and moving the recording means and the optical system relative to each other.

3. A microfilm typewriter comprising:

means for designating a character, numeral or symbol;

support means for supporting a recording medium having a layer of a dispersion imaging material formed on a substrate;

a printing light source for generating light of energy density high enough to cause a sufficient dispersion of the dispersion imaging material immediately to form an image without any development process when the light is applied to the recording medium;

an optical mask having formed thereon character, numeral and symbol patterns of a size in the range of about 20 to about 500 μm, which converts the light of the printing light source into a light of a pattern of the character, numeral or symbol designated by the designating means to irradiate the recording medium with the converted light of the character, numeral or symbol pattern, the size of the character, numeral or symbol pattern to achieve printing being in the range of about 20 to about 500 μm;

first means for moving the optical mask and the printing light source relative to each other to select and irradiate the designated character, numeral or symbol pattern with the light of the printing light source;

second means for moving the recording medium support means and the position of irradiating the recording medium with the converted light of the character, numeral or symbol pattern relative to each other with accuracy high enough to print characters, numerals or symbols one by one on the recording medium at predetermined positions; and projecting means for optically providing on a fixed screen a magnified display of the character, numeral or symbol printed on the recording medium in the neighborhood of the printing position during the printing operation;

wherein the printing light source is a laser, and wherein gap forming means is provided for forming a gap of a size ranging from about 5 μm to about 2 mm between the pattern forming surface of the optical mask and the recording medium; and wherein the gap forming means comprises separating means for blowing a pressurized gas between the optical mask and the recording medium, and urging means for urging the optical mask and the recording medium toward each other.

4. The microfilm typewriter according to claim 3, wherein said urging means comprises fluid pressure means for urging the optical mask and the recording medium toward each other.

5. The microfilm typewriter according to claim 3, wherein the projecting means includes an optical system for applying a read-out light to a predetermined region including the printing position of the recording medium to project the character, numeral or symbol printed in the predetermined region to the fixed screen, and means for interlocking the optical system with the movement of the moving means.

6. The microfilm typewriter according to claim 5, wherein said urging means comprises fluid pressure means for urging the optical mask and the recording medium toward each other.

7. A microfilm typewriter comprising:

means for designating a character, numeral or symbol;

support means for supporting a recording medium having a layer of a dispersion imaging material formed on a substrate;

a printing light source for generating light of energy density high enough to cause a sufficient dispersion of the dispersion imaging material immediately to form an image without any development process when the light is applied to the recording medium;

an optical mask having formed thereon character, numeral and symbol patterns of a size in the range of about 20 to about 500 μm, which converts the light of the printing light source into a light of a pattern of the character, numeral or symbol designated by the designating means to irradiate the recording medium with the converted light of the character, numeral or symbol pattern, the size of the character, numeral or symbol pattern to achieve printing being in the range of about 20 to about 500 μm;

first means for moving the optical mask and the printing light source relative to each other to select and irradiate the designated character, numeral or symbol pattern with the light of the printing light source;

second means for moving the recording medium support means and the position of irradiating the recording medium with the converted light of the character, numeral or symbol pattern relative to each other with accuracy high enough to print characters, numerals or symbols one by one on the recording medium at predetermined positions; and projecting means for optically providing on a fixed screen a magnified display of the character, numeral or symbol printed on the recording medium in the neighborhood of the printing position during the printing operation;

wherein the optical mask is a negative mask in which the character, numeral and symbol patterns are transparent;

wherein the region of the opaque portion serving as the background of each of the character, numeral and symbol patterns of the negative mask is limited and surrounded by a transparent region, the area of the opaque portion being about 2 to about 100 times the size of each of the character, numeral and symbol patterns and larger than the spot size of the light applied to the negative mask from the printing light source;

wherein the negative mask is a disk-shaped one having the patterns arranged on the same circle at substantially equiangular intervals; and wherein a transparent portion is formed on the circle on which the patterns are arranged, the transparent portion being large enough to permit the transmission therethrough of a light from the entire area of one page of the recording medium irradiated by a read-out light, and wherein there is provided means for placing one page of the recording medium, including the part to be irradiated by the converted light, in opposed relation to the transparent portion except when the converted light is applied to the recording medium.

8. The microfilm typewriter according to claim 7, wherein there is provided on the transparent portion at the printing light irradiating position an index indicating the next position to be printed when the transparent portion and the page of the recording medium being printed are opposed to each other.

9. The microfilm typewriter according to claim 7, wherein the projecting means includes an optical system for applying a read-out light to a predetermined region including the printing position of the recording medium to project the character, numeral or symbol printed in the predetermined region to the fixed screen, and means for interlocking the optical system with the movement of the moving means.

10. The microfilm typewriter according to claim 9, wherein there is provided on the transparent portion at the printing light irradiating position an index indicating the next position to be printed when the transparent portion and the page of the recording medium being printed are opposed to each other.

* * * * *